US010231546B2

(12) United States Patent
Loew et al.

(10) Patent No.: US 10,231,546 B2
(45) Date of Patent: Mar. 19, 2019

(54) CHAIR BACK TILT MECHANISM

(71) Applicant: Knoll, Inc., East Greenville, PA (US)

(72) Inventors: Glen Oliver Loew, Hamburg (DE); Andrew Blair Hector, Red Hill, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 15/906,246

(22) Filed: Feb. 27, 2018

(65) Prior Publication Data

US 2018/0249835 A1 Sep. 6, 2018

Related U.S. Application Data

(60) Provisional application No. 62/465,924, filed on Mar. 2, 2017.

(51) Int. Cl.

| | |
|---|---|
| ***A47C 3/025*** | (2006.01) |
| ***A47C 3/026*** | (2006.01) |
| ***A47C 1/032*** | (2006.01) |
| ***A47C 3/22*** | (2006.01) |

(52) U.S. Cl.

CPC ..... *A47C 1/03272* (2013.01); *A47C 1/03255* (2013.01); *A47C 1/03294* (2013.01); *A47C 3/22* (2013.01)

(58) Field of Classification Search

CPC ... A47C 3/22; A47C 1/03294; A47C 1/03255; A47C 1/03272

USPC ..... 297/285–299, 300.1–301.7, 317, 318, 297/341, 342, 322

See application file for complete search history.

(56) References Cited

U.S. PATENT DOCUMENTS

| | | | | |
|---|---|---|---|---|
| 4,383,714 A * | 5/1983 | Ishida | A47C 3/03 297/261.3 |
| 4,840,426 A | 6/1989 | Vogtherr et al. | |
| 5,308,145 A * | 5/1994 | Koepke | A47C 1/03255 297/342 X |
| 5,314,237 A * | 5/1994 | Koepke | A47C 1/03294 297/318 |
| 5,354,120 A * | 10/1994 | Volkle | A47C 1/03255 297/342 X |

(Continued)

FOREIGN PATENT DOCUMENTS

| | | |
|---|---|---|
| DE | 10306851 A1 | 8/2004 |
| EP | 0309804 B1 | 12/1992 |

(Continued)

OTHER PUBLICATIONS

International Search Report for PCT/US2018/020141 dated Apr. 24, 2018.

(Continued)

*Primary Examiner* — Rodney B White

(74) *Attorney, Agent, or Firm* — Buchanan Ingersoll & Rooney PC

(57) ABSTRACT

A chair can include a chair back, or backrest, that is coupled to a base of a chair above a seat of the chair. A tilt mechanism can attach the backrest to the base at spaced apart locations. In some embodiments, the tilt mechanism can be configured so that the backrest rotates about multiple pivots as it reclines from an upright position to a reclined position to drive forward motion of the seat during recline of the backrest.

19 Claims, 8 Drawing Sheets

(56) References Cited

U.S. PATENT DOCUMENTS

| | | | | |
|---|---|---|---|---|
| 5,577,802 | A * | 11/1996 | Cowan | A47C 3/0257 297/301.2 |
| 5,871,258 | A * | 2/1999 | Battey | A47C 1/023 297/317 X |
| 6,685,267 | B1 * | 2/2004 | Johnson | A47C 1/023 297/317 X |
| 6,817,667 | B2 | 11/2004 | Pennington et al. | |
| 6,824,214 | B2 | 11/2004 | McMillen | |
| 6,863,346 | B2 * | 3/2005 | Zund | A47C 1/023 297/322 |
| 6,923,503 | B2 * | 8/2005 | Sangiorgio | A47C 1/03255 297/342 X |
| 6,945,605 | B2 * | 9/2005 | Kinoshita | A47C 1/023 297/317 |
| 7,048,335 | B2 * | 5/2006 | Norman | A47C 1/023 297/342 X |
| 7,198,329 | B1 | 4/2007 | Larson | |
| 7,325,873 | B2 * | 2/2008 | Stewart | A47C 3/04 297/300.6 X |
| 7,380,881 | B2 * | 6/2008 | Freed | A47C 1/023 297/317 |
| 7,478,880 | B2 * | 1/2009 | Johnson | A47C 1/023 297/342 |
| 7,497,515 | B2 * | 3/2009 | Krehm | A47C 3/026 297/300.5 X |
| 7,887,131 | B2 | 2/2011 | Chadwick et al. | |
| 8,029,060 | B2 | 10/2011 | Parker et al. | |
| 8,157,329 | B2 | 4/2012 | Masoud et al. | |
| 8,167,373 | B2 | 5/2012 | Allison et al. | |
| 8,216,416 | B2 | 7/2012 | Allison et al. | |
| 8,662,586 | B2 * | 3/2014 | Serber | A47C 1/023 297/318 X |
| 8,752,896 | B2 * | 6/2014 | Takeuchi | A47C 1/03 297/341 X |
| 9,462,889 | B2 * | 10/2016 | Piretti | A47C 1/03261 |
| 9,486,079 | B2 * | 11/2016 | Romero | A47C 1/023 |
| 2002/0180248 | A1 * | 12/2002 | Kinoshita | A47C 1/023 297/322 X |
| 2003/0168901 | A1 | 9/2003 | Wilkerson et al. | |
| 2006/0006715 | A1 | 1/2006 | Chadwick et al. | |
| 2006/0244294 | A1 | 11/2006 | Dozsa-Farkas | |
| 2008/0012412 | A1 * | 1/2008 | Piretti | A47C 1/03233 297/341 |
| 2008/0290712 | A1 | 11/2008 | Parker et al. | |
| 2009/0146476 | A1 * | 6/2009 | Kan | A47C 1/03255 297/284.4 |
| 2013/0221719 | A1 * | 8/2013 | Costaglia | A47C 1/03294 297/340 |
| 2016/0331137 | A1 * | 11/2016 | Costaglia | A47C 1/03255 |

FOREIGN PATENT DOCUMENTS

| | | | |
|---|---|---|---|
| EP | 141073 | B1 | 9/2004 |
| EP | 1410738 | B1 | 9/2004 |
| EP | 1878360 | A1 | 1/2008 |

OTHER PUBLICATIONS

Written Opinion of the International Searching Authority for PCT/US2018/020141 dated Apr. 24, 2018.

* cited by examiner

CHAIR BACK TILT MECHANISM

CROSS-REFERENCE TO RELATED APPLICATIONS

The present application claims priority to U.S. Provisional Patent Application No. 62/465,924, filed on Mar. 2, 2017.

FIELD OF INVENTION

The present invention relates to chairs, tilt mechanisms for chairs, and methods of making and using chairs.

BACKGROUND OF THE INVENTION

Chairs often include a base that supports a seat. Examples of chairs may be appreciated from U.S. Pat. Nos. 8,216,416, 8,167,373, 8,157,329, 8,029,060, 7,887,131, 7,198,329, 6,824,218, and 6,817,667 and U.S. Pat. App. Pub. Nos. 2003/0168901, 2006/0006715, and 2008/0290712. Some chairs may be configured to have a back that tilts from an upright position to a recline position.

SUMMARY OF THE INVENTION

A chair is provided that includes a seat, a backrest, and a base. The chair can include a tilt mechanism to facilitate tilting of the backrest from an upright position to a reclined position. The tilt mechanism can be configured so that the seat moves forwardly when the backrest is tilted to the reclined position. The tilt mechanism can also be configured so that the seat moves upwardly or downwardly at the same time the seat is moved forwardly during recline of the backrest.

In some embodiments, the chair can include a seat, a backrest and a base. The seat can be supported by the base and at least one portion of the backrest can be connected to at least one of a seat frame of the seat and the base. A tilt mechanism can be attached between the base, the seat, and the backrest. The tilt mechanism can include seat connections between a seat frame of the seat and a housing of the base that are configured to define a path of travel of the seat when the seat moves during recline of the backrest from an upright position to a reclined position, seat pivotal connections between projections of the backrest and the seat frame of the seat that are configured so that the projections rotate during rotation of the backrest from the upright position to the reclined position to drive the seat frame forward along the path of travel during the recline of the backrest from the upright position to the reclined position, and backrest pivotal connections between vertically extending members of the backrest and vertically extending members of the housing. The backrest can rotate about the backrest pivotal connections and the seat pivotal connections during motion of the backrest between the upright position and the reclined position. The tilt mechanism can be configured so that the seat can moves forwardly synchronously with rotation of the backrest during recline of the backrest from the upright position to the reclined position.

In some embodiments, the base includes a height adjustment device connected to the housing and an actuator connected to the height adjustment device. In some embodiments, the height adjustment device can include a gas spring and the actuator can include a lever or other type of member that a user can grasp and manipulate to actuate movement of the gas spring for facilitating height adjustment. In some embodiments, the actuator can be connected to the height adjustment device within the housing below the seat.

Embodiments of the chair can also include a first biasing device attached between the seat frame and the housing. The first biasing device can be configured to stretch from a first length to a second length that is longer than the first length when the seat is moved forwardly as the backrest is moved from the upright position to the reclined position. The first biasing device can be configured to bias the seat to a rearward position to bias the backrest to the upright position. In some embodiments, the first biasing device can be structured as a coil spring, an elastomeric strap, an elastomeric elongated body, a polymeric body, or a type of elongateable spring member.

In some embodiments, each of the seat connections can include a connector positioned within an elongated slot defined in the seat frame connected to a portion of the housing to attach the housing to the seat frame. The portion of the housing to which the connector is attached can be a ramped portion so that the connector is inclined or declined within the slot to define an inclined or declined path of travel of the seat so that the seat moves upwardly or downwardly as the seat moves forwardly.

In some embodiments, each of the seat pivotal connections between projections of the backrest and the seat frame of the seat can include a first axle that extends through a slit defined in the projection of the backrest of the seat pivotal connection adjacent an aperture defined in the seat frame that is rearward of a slot of a respective one of the seat connections. The first axle can be pivotally connecting the projection of the backrest to the seat frame. For such embodiments, each of the seat connections can include a connector positioned within the slot defined in the seat frame to attach the seat frame to the housing. The portion of the housing to which the connector is attached can be a ramped portion so that the connector is inclined or declined within the slot to define an inclined or declined path of travel of the seat so that the seat moves upwardly or downwardly as the seat moves forwardly.

In some embodiments of the chair, each of the backrest pivotal connections between vertically extending members of the backrest and vertically extending members of the housing can include a first axle extending from an upper end of a vertically extending member of the housing to a vertically extending member of the backrest such that the backrest is rotatable about the first axle. Each of the seat pivotal connections between projections of the backrest and the seat frame of the seat can include a second axle that extends through a slit defined in the projection of the backrest of the seat pivotal connection adjacent an aperture defined in the seat frame. The second axle can pivotally connect the projection of the backrest to the seat frame so that rotation of the projection that occurs when the backrest is moved from the upright position to the reclined position drives the seat frame forwardly. Each of the seat connections can also include a connector positioned within an elongated slot defined in the seat frame to attach the seat frame to the housing. The portion of the housing to which the connector is attached can be a ramped portion so that the connector is inclined or declined within the slot to define an inclined or declined path of travel of the seat so that the seat moves upwardly or downwardly as the seat moves forwardly.

In other embodiments of the chair, each of the seat connections can include a connector positioned within an elongated slot defined in the seat frame to attach the seat frame to the housing. A portion of the housing to which the connector is attached can be a ramped portion so that the connector is inclined or declined within the slot to define an inclined or declined path of travel of the seat so that the seat moves upwardly or downwardly as the seat moves forwardly. The connector can be forward of the seat pivotal connections and the seat pivotal connections can be forward of the backrest pivotal connections. The projections of the backrest can extend from a lower portion of the backrest through holes in the housing to the seat pivotal connections.

The backrest of the chair can have a number of different configurations. In some embodiments, the backrest can include an upper portion and a lower portion having the projections. The projections can extend from the lower portion of the backrest into the housing. The upper portion, lower portion, and the vertically extending members of the backrest can define at least one opening. The vertically extending members of the backrest can include a first vertically extending member and a second vertically extending member that are spaced apart. The first vertically extending member can be adjacent a first side of the backrest and the second vertically extending member can be adjacent a second side of the backrest.

Embodiments of the chair can include at least one biasing device. For instance, embodiments can include first and second biasing devices attached between the seat frame and the housing. The first biasing device can be spaced apart from the second biasing device within the housing. Each of the first and second biasing device can be configured to stretch from a first length to a second length that is longer than the first length when the seat is moved forwardly as the backrest is moved from the upright position to the reclined position. The first and second biasing devices can be configured to bias the seat to a rearward position to bias the backrest to the upright position. Such embodiments can be configured so that seat connections between a seat frame of the seat and the housing of the base are configured to define a path of travel of the seat when the seat moves during recline of the backrest from an upright position to a reclined position include first and second seat connections that are aligned with each other and are spaced apart from each other where the seat connections are forward of the seat pivotal connections. The seat pivotal connections between the projections of the backrest and the seat frame of the seat that are configured so that the projections rotate during rotation of the backrest from the upright position to the reclined position to drive the seat frame forward along the path of travel during recline of the backrest from the upright position to the reclined position for such embodiments can include first and second seat pivotal connections that are spaced apart from each other and aligned with each other where the seat pivotal connections are forward of the backrest pivotal connections. The backrest pivotal connections between the vertically extending members of the backrest and the vertically extending members of the housing for such embodiments can include first and second backrest pivotal connections that are spaced apart from each other and are aligned with each other where the backrest pivotal connections are rearward of the seat connections and the seat pivotal connections. Each of the backrest pivotal connections between vertically extending members of the backrest and vertically extending members of the housing for such embodiments can include a first axle extending from an upper end of the vertically extending member of the housing to the vertically extending member of the backrest of the backrest pivotal connection such that the backrest is rotatable about the first axle. Each of the seat pivotal connections between the projections of the backrest and the seat frame of the seat can include a second axle that extends through a slit defined in the projection of the backrest of the seat pivotal connection adjacent an aperture defined in the seat frame, the second axle pivotally connecting the projection of the backrest to the seat frame so that rotation of the projection that occurs when the backrest is moved from the upright position to the reclined position drives the seat frame forwardly. Each of the seat connections can include a connector positioned within an elongated slot defined in the seat frame to attach the seat frame to the housing. A portion of the housing to which the connector is attached can be a ramped portion so that the connector is inclined or declined within the slot to define an inclined or declined path of travel of the seat so that the seat moves upwardly or downwardly as the seat moves forwardly.

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of the chair and tilt mechanism for the chair are shown in the accompanying drawings. It should be appreciated that like reference numbers used in the drawings may identify like components.

DETAILED DESCRIPTION OF EXEMPLARY EMBODIMENTS

Figure 1:
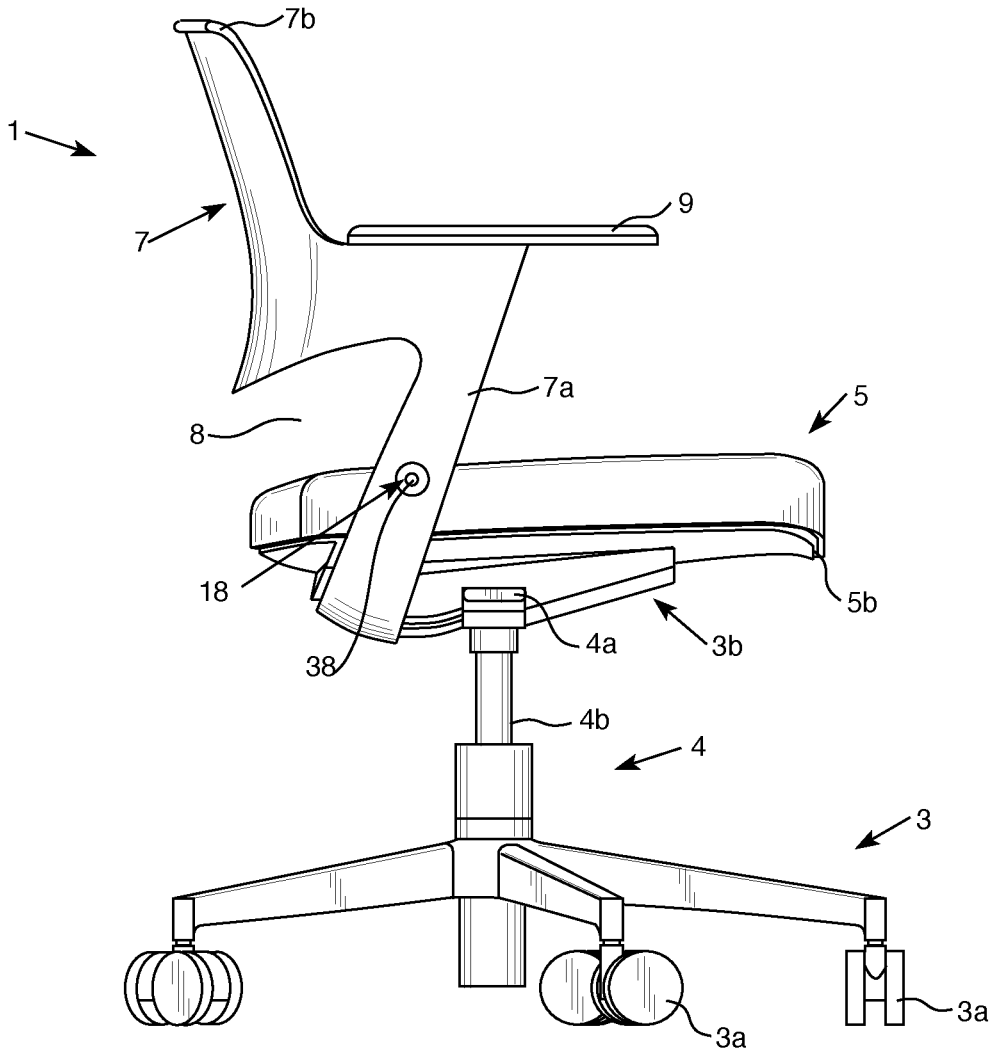
FIG. 1 is a perspective view of a first exemplary embodiment of a chair.
Figure 2:
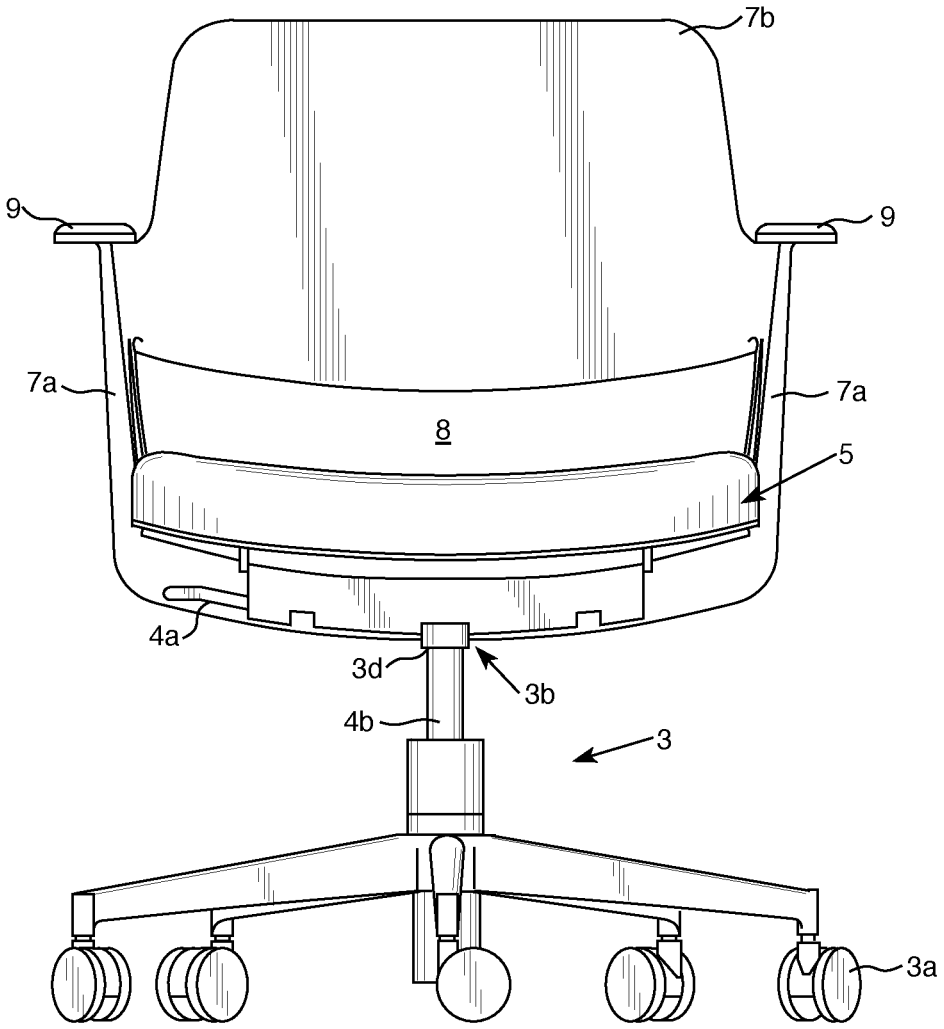
FIG. 2 is a perspective view of the first exemplary embodiment of the chair.

A chair 1 can include a base 3 that supports a seat 5 and a backrest 7. The base 3 can be configured as a pedestal base that is supported by rotatable castors 3*a* that engage the floor and are moveable to allow the base to be slid or wheeled along a floor. In some alternative embodiments, the base 3 can be configured to have a plurality of legs that can have a bottom end that contact the floor or directly engage a floor or are attached to glides that are configured to contact the floor.

The chair 1 can include armrests positioned above the seat 5. The armrests 9 can be attached to a portion of the back frame of the backrest 7, a portion of the seat frame of the seat 5, and/or the base 3 so that the armrests are supported above the seat 5. The armrests may be moveable independent of the base 3 and/or backrest 7 or may be affixed to the backrest 7 such that the armrests 9 move in coordination with and simultaneously with the backrest 7 as the backrest 7 moves between an upright position and a reclined position.

The backrest 7 can be configured to include an upper portion 7*b* and a lower portion that has vertically extending members 7*a* that extend from the lower portion to the upper portion 7*b*. the lower portion of the backrest can also include projections 7*c* that extend from the lower portion of the backrest to a housing 3*b* of the base 3 that is below the seat 5. The lower portion, spaced apart first and second vertically extending members 7*a* and the upper portion 7*b* can define an opening 8 between the seat 5 and the upper portion 7*b* of the backrest 7. The upper portion 7*b* of the backrest 7 can be shaped and configured to contact a user's back as the user is seated on the seat 5.

The backrest 7 can be configured so that a back skin is also attached to the backrest. The back skin may provide a covering for at least a portion of the backrest. A cushion or upholstery can be positioned between such a covering and the backrest 7 as well.

Each of the armrests 9 can be affixed to a portion of the backrest 7 that is located between the upper portion 7*b* and the backrest 7 and a respective one of the vertically extending members 7*a* to be supported above the seat 5. For example, a first armrest 9 can be attached between the upper portion 7*b* of the backrest 7 and a first vertically extending member 7*a* of the backrest 7 adjacent a first side of the backrest 7 and a second armrest 9 can be attached between the upper portion 7*b* of the backrest 7 and a second vertically extending member 7*a* of the backrest 7 adjacent a second side of the backrest 7 that is opposite the first side of the backrest 7. In other embodiments, the armrests 9 can be attached to the seat 5, the seat frame or the base to be supported above the seat 5.

The seat 5 can include a cushion 5*a* that is supported by a seat frame 5*b*. The cushion may be covered by a covering (e.g. a fabric or leather covering, etc.). In other embodiments, the seat 5 can include a polymeric material, an elastomeric material, a mesh material or a fabric that is suspended over a seat frame or attached to a seat frame. Such embodiments may not utilize a cushion 5*a*.

The base 3 can include a lower portion 3*c* that has castors 3*a* or glides for engaging a floor to support the seat 5 and backrest 7. The base 3 can also include a housing 3*b* that is below the seat 5 and coupled to the seat frame of the seat 5 to support the seat 5. The backrest 7 can also be attached to the base 3 via the housing 3*b*. The base can include a height adjustment mechanism 4 that extends from the housing 3*b* to the lower portion of the base 3 that may engage a floor. The height adjustment mechanism 4 can include an actuator 4*a* that is coupled to a gas spring or other type of height adjustment device 4*b* via an elongated member 4*c* (e.g. a wire, cable, or arm-structure). The actuator 4*a* can be attached to the housing 3*b* and be configured to be moveable to effect actuation of the height adjustment device 4*b* so that the height of the seat 5 and backrest 7 can be moved upwardly or downwardly. For instance, the actuator 4*a* can be configured so that movement of the actuator from a first position to a second position allows the height adjustment device 4*b* to be moved to an unlocked position to permit height adjustment. Movement of the actuator from the second position to the first position can be configured to cause the height adjustment device to be moved from its unlocked position to its locked position to prevent further height adjustment and to maintain the position of the seat 5 and backrest 7 at its user selected position until the actuator 4*a* is again moved to effect another height adjustment. A spring device 17 (e.g. a leaf spring, coil spring, etc.) can be positioned in the housing 3*b* to bias the actuator 4*a* to its first position so that the height adjustment device 4*b* is biased to its locked position for maintaining a height of the housing 3*b*. This can require a user to provide a force for manipulating the actuator to its second position to permit height adjustment of the height adjustment device 4*b* for raising or lowering the position of the housing 3*b* and the seat 5 and backrest 7 attached to the housing 3*b*.

In some embodiments, the housing 3*b* can include an opening 3*d* for receiving a portion of a gas spring or other type of height adjustment device 4*b*. In some embodiments, a knock down mechanism or other type of mechanism may be positioned in the housing 3*b* adjacent opening 3*d* to receive and retain an upper end of a gas spring, for example, to facilitate actuation of a valve for permitting height adjustment via actuator 4*a*. U.S. Pat. No. 8,388,066 discloses an example of such a mechanism that can be positioned adjacent opening 3*d* such that motion of the actuator 4*a* can actuate height adjustment via the height adjustment device 4*b*. The entirety of U.S. Pat. No. 8,388,066 is incorporated by reference herein.

The chair 1 can also include a tilt mechanism 6 that is configured to facilitate tilting of the backrest 7 from an upright position to a reclined position. The tilt mechanism 6 can also be configured so that the seat 5 moves simultaneously with the backrest such that when the backrest tilts from the upright position to the reclined position, the seat moves in a first direction and when the backrest tilts from the reclined position to the upright position the seat moves in a second direction that is opposite the first direction. The seat 5 and backrest 7 can move relative to the housing 3*b* to which the seat 5 and backrest 7 are attached via the tilt mechanism 6.

In some embodiments, the seat 5 can be connected to the tilt mechanism 6 so that the seat moves forwardly when the backrest 7 tilts backwardly to a reclined position and the seat moves rearwardly when the backrest tilts from the reclined position to the upright position. In other embodiments, it is contemplated that the seat 5 can be configured to move rearwardly when the backrest tilts to the reclined position and the seat 5 can move forwardly when the backrest tilts from a reclined position to the upright position. During the forward or rearward movement of the seat 5 that may occur simultaneously during tilting motion of the backrest, the seat 5 can also be configured to move upwardly or downwardly on a path of motion via its connection to the tilt mechanism 6. For instance, in some embodiments the seat 5 can be configured to move upwardly and forwardly or downwardly and forwardly when the backrest tilts from an upright position to a reclined position and the seat 5 can move downwardly and rearwardly or upwardly and rearwardly when the backrest 7 tilts from the reclined position to the upright position via its connection to the tilt mechanism 6. As alternative examples, the seat 5 can be configured to move upwardly and rearwardly or downwardly and rearwardly when the backrest 7 tilts from an upright position to a reclined position and the seat 5 can be configured to move downwardly and forwardly or upwardly and forwardly when the backrest 7 tilts from the reclined position to the upright position via it connection to the tilt mechanism 6. The path of motion that the seat may follow during such movement that may synchronously occur with the tilting of the backrest 7 can be a linear path of motion or a curved path of motion that is at least partially defined by its connection to the tilt mechanism 6.

Figure 3:
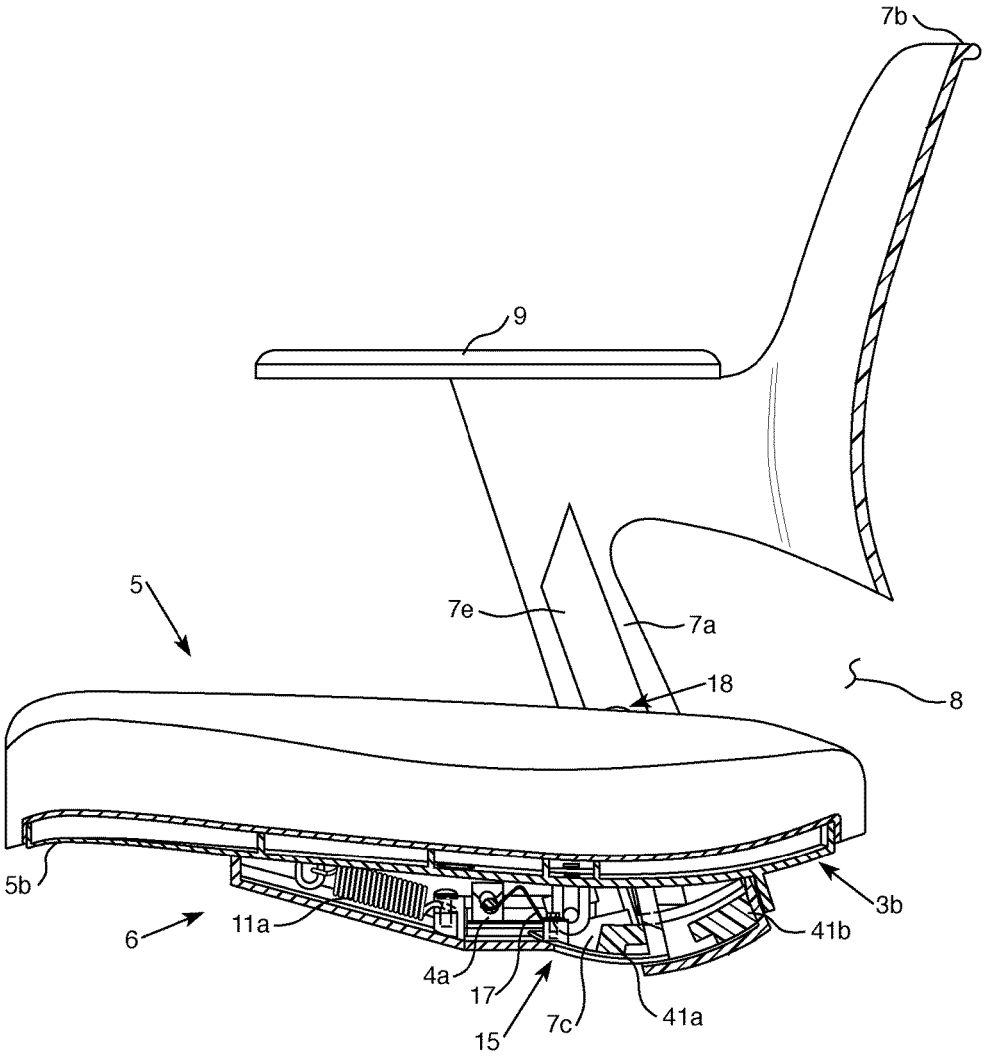
FIG. 3 is a cross sectional view of the first exemplary embodiment of the chair in an upright position.
Figure 4:
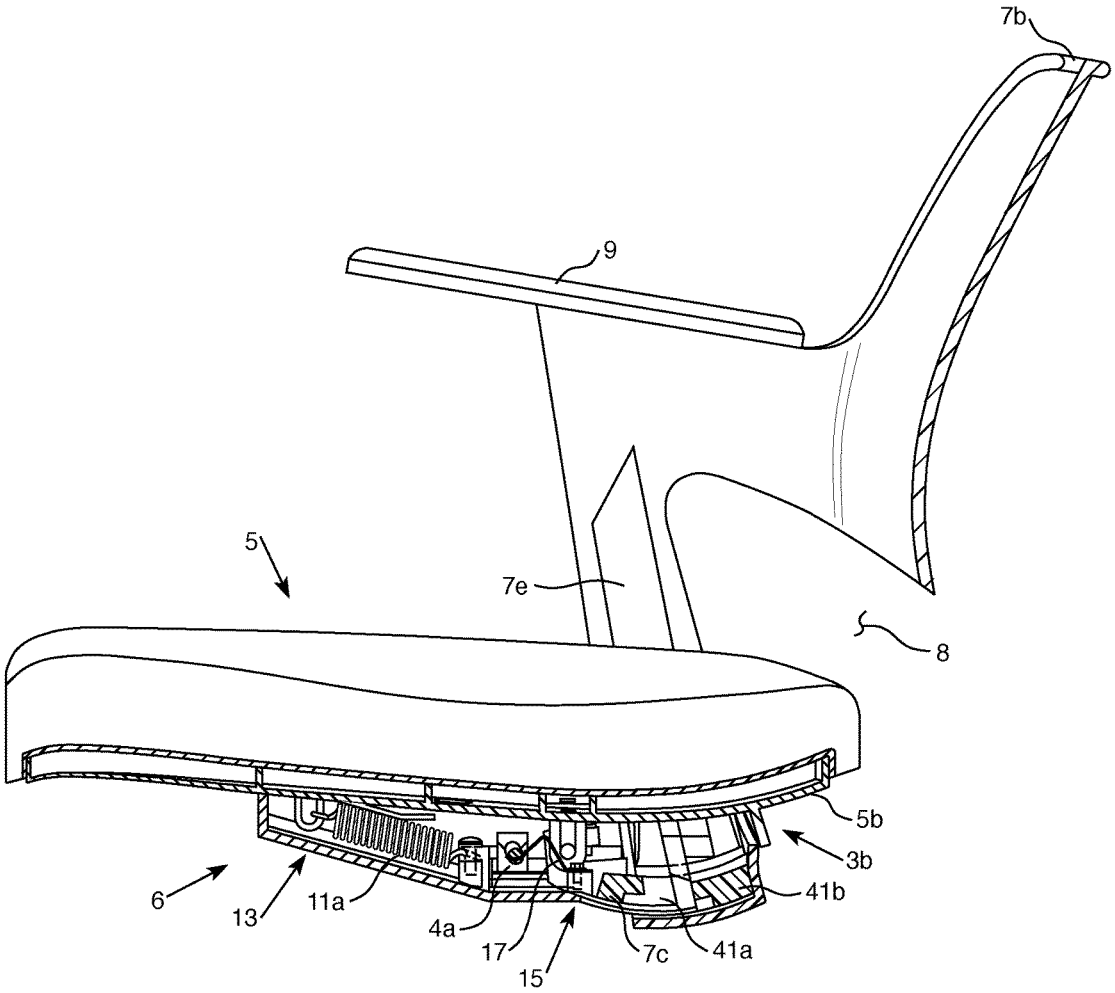
FIG. 4 is cross sectional view similar to FIG. 3 of the first exemplary embodiment of the chair in a reclined position.
Figure 5:
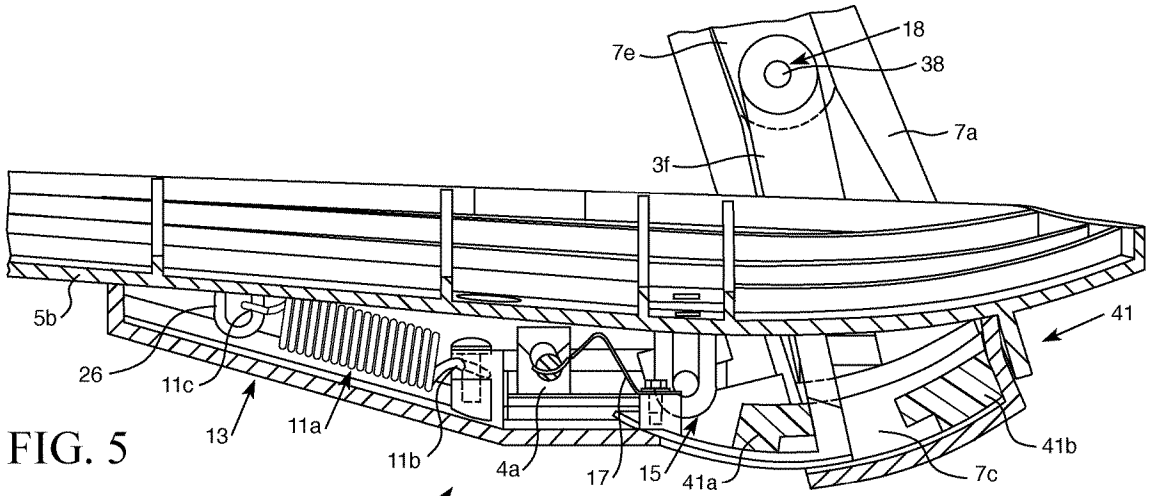
FIG. 5 is a cross sectional view of the first exemplary embodiment of the chair in the upright position.
Figure 6:
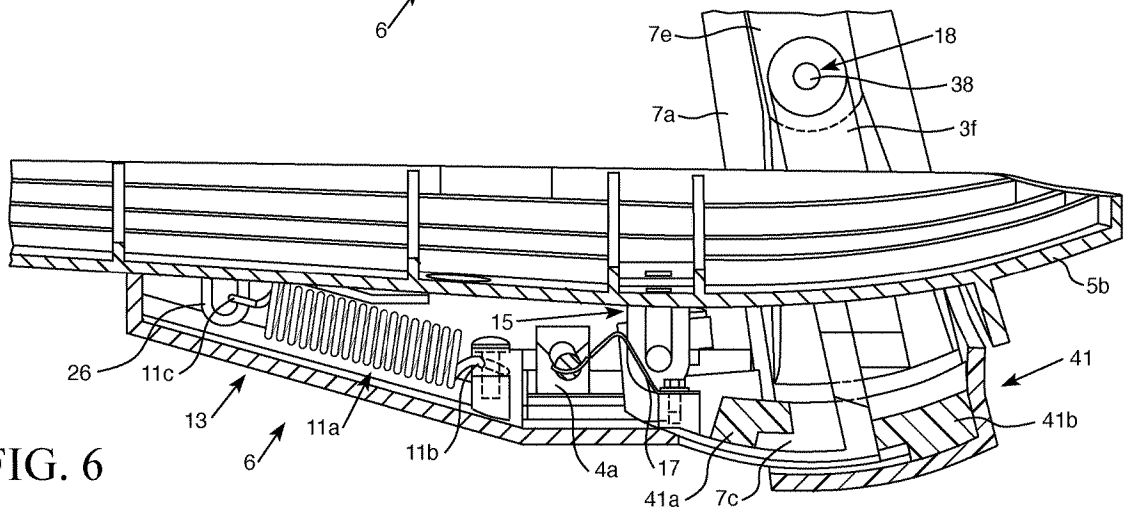
FIG. 6 is a cross sectional view similar to FIG. 5 of the first exemplary embodiment of the chair in the reclined position.
Figure 7:
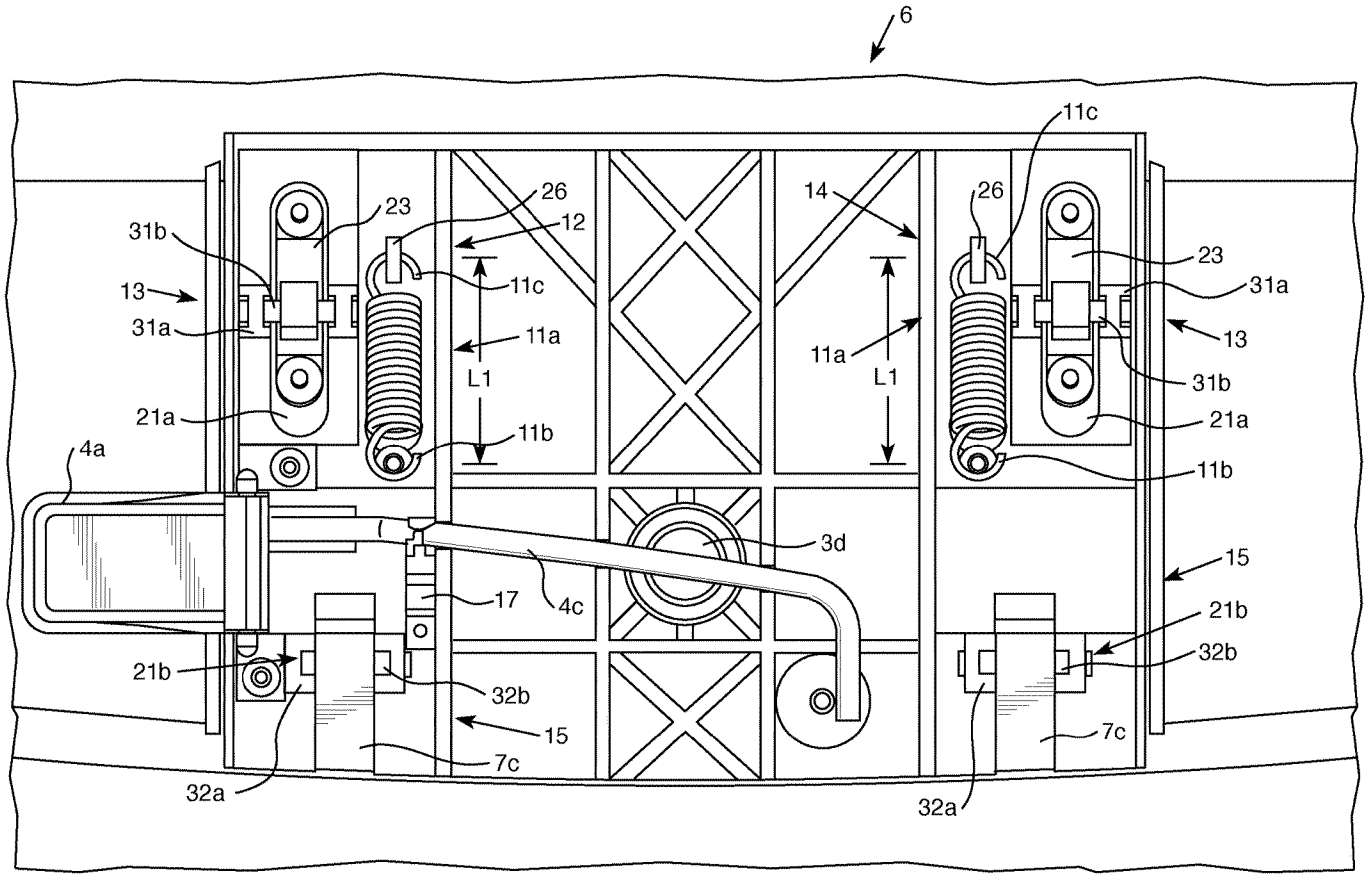
FIG. 7 is a fragmentary bottom view of the first exemplary embodiment of the chair in the upright position with a portion of the seat cut away to illustrate components of the tilt mechanism 6.
Figure 8:
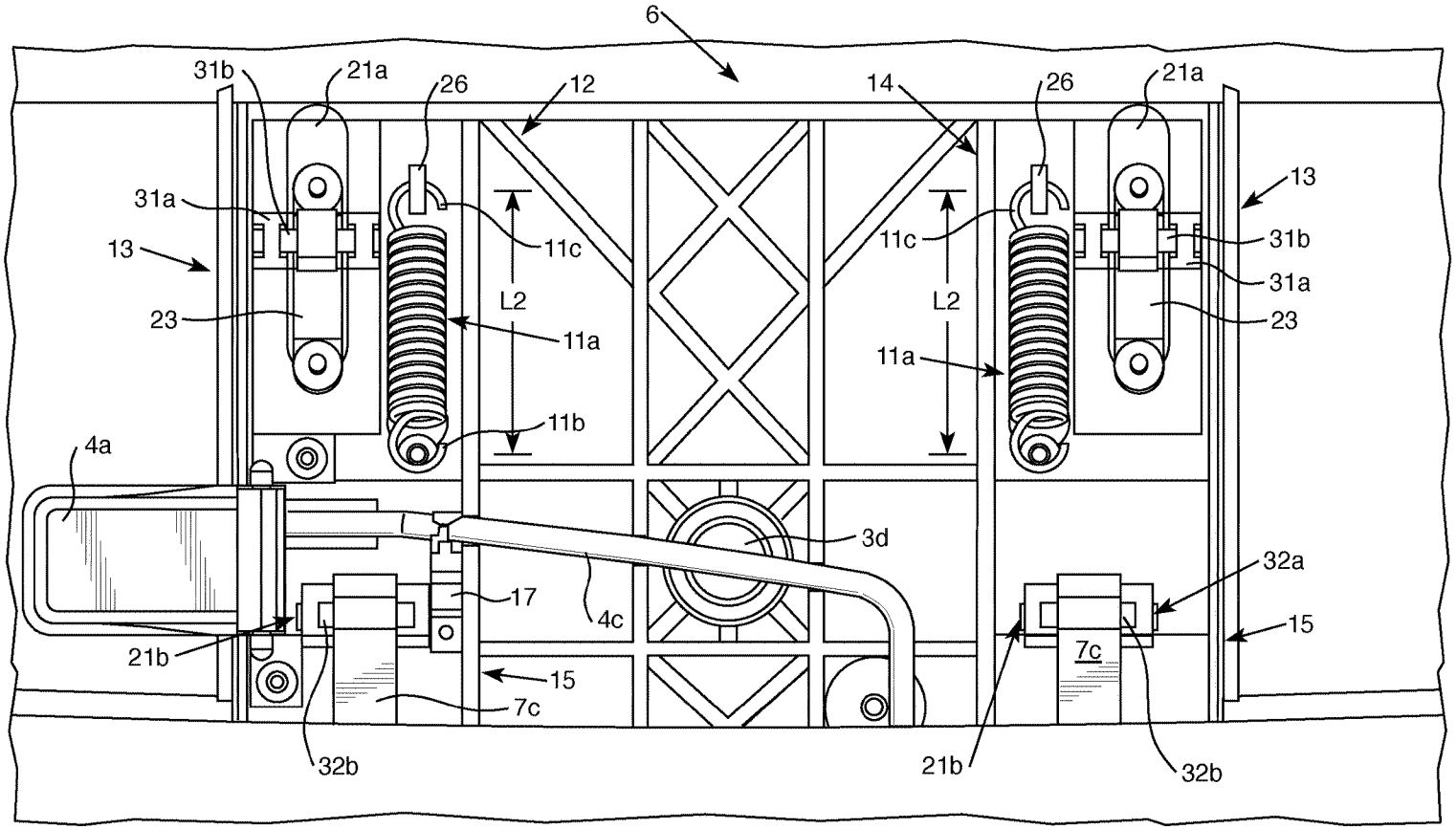
FIG. 8 is a fragmentary bottom view similar to FIG. 7 of the first exemplary embodiment of the chair in the reclined position.
Figure 9:
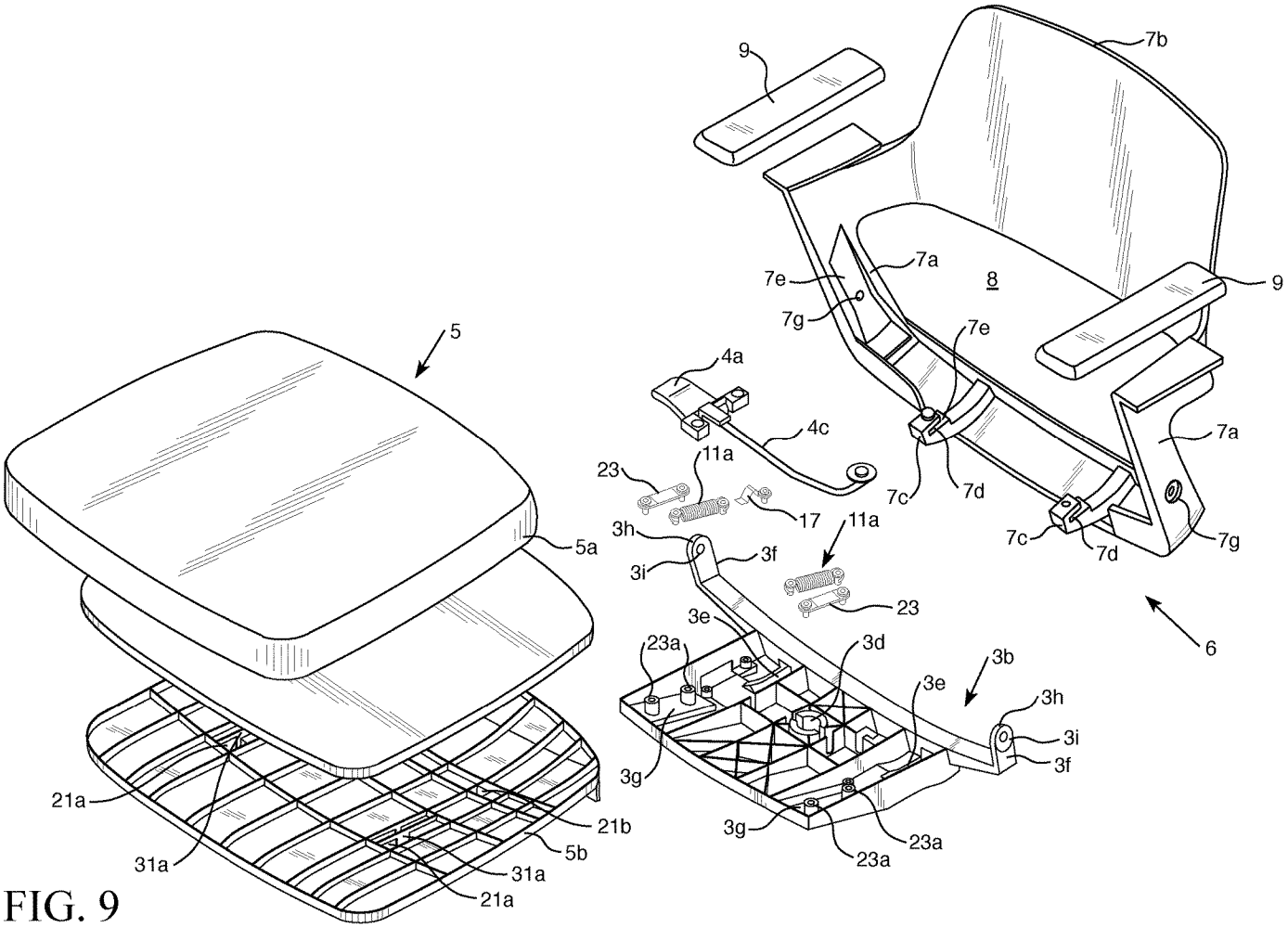
FIG. 9 is a fragmentary exploded view of the first exemplary embodiment of the chair illustrating components of the tilt mechanism 6, backrest 7, armrests 9, housing 3*b*, and seat 5.

As may best be seen from FIGS. 3-9, the tilt mechanism 6 can include a number of different elements. The elements of the tilt mechanism 6 can include one or more biasing devices 11*a* and pivotal connections formed between portions of the tilt mechanism 6 and the seat 5 and/or backrest 7. The pivotal connections can be defined by structure of the seat 5 and/or backrest 7 being pivotally connected together so that one or more biasing devices 11*a* can bias the backrest 7 to its upright position while resiliently extending to permit backrest tilting to a reclined position when a user provides a force against the backrest 7 to tilt the backrest rearwardly. The force provided by a user to move the backrest 7 rearwardly may also provide the force that is used to move the seat in its first direction synchronously with tilting of the backrest 7. The biasing force provided by the one or more biasing devices 11 can be configured to cause the backrest 7 to move from its reclined position to its upright position when a user no longer supplies a force on the backrest. The biasing force provided by the at least one biasing device 11*a* can also drive motion of the seat in the second direction that may occur synchronously with the motion of the backrest 7 from its reclined position to the upright position.

In some embodiments, the tilt mechanism 6 can include biasing devices 11*a* that include a first biasing device 12 and a second biasing device 14. Each of these biasing devices can be configured as a coil spring, an elastomeric elongated member, or another type of spring, spring device, or resilient biasing mechanism. Each biasing device may be positioned within the housing 3*b* supported by the base that is below the seat 5. The housing 3*b* can define one or more spaces below the seat for receiving multiple biasing devices and other structure for forming pivotal connections to facilitate synchronous motion of the seat and backrest that can occur relative to the housing 3*b* during backrest tilting between the upright and reclined positions of the backrest 7.

In some embodiments, the first biasing device 12 can be positioned adjacent a first side of the housing 3*b* on a first side of the opening 3*d* (e.g. a left side or right side of the opening 3*d*) and the second biasing device 14 can be positioned adjacent a second side of the housing 3*b* that is opposite the first side (e.g. the right side or left side of the opening 3*d*). The first and second biasing devices 12 and 14 can be connected via similar structure adjacent opposite sides of the housing 3*b* as can be appreciated from FIGS. 7-8. For instance, each biasing device 11*a* can have a first end 11*b* and a second end 11*c*. The first end 11*b* can be connected to structure attached to the housing 3*b* or structure defined in a body of the housing 3*b*. The second end can be connected to the seat frame 5*b* via a biasing device connection structure 26 attached to or defined in the seat frame 5*b*. Such a biasing device connection structure 26 can include an aperture, eyelet, hook, or other structure defined by or attached to a body of the seat frame 5*b* that is sized to facilitate connection of the second end 11*c* of the biasing device 11*a* to the seat 5 via the seat frame 5*b* of the seat 5. The connection structure 26 could alternatively be a hook, bolt, or bracket other type of fastener attached to the seat frame 5*b* to facilitate connection of the second end 11*c* of the biasing device 11*a* with the seat frame 5*b*.

The tilt mechanism 6 can also include first seat connections 13 between the seat 5 and the housing 3*b*, second seat pivotal connections 15 between the backrest 7 and the seat 5, and third backrest pivotal connections 18 between the backrest 7 and the housing 3*b*. The first seat connections 13 can be positioned so that these connections are aligned with each other and are located in corresponding locations on opposite sides of the housing 3*b* and seat frame 5*b*.

Each first seat connection 13 can include an axle 31*b* that extends through an aperture defined by structure 31*a* of the seat frame 5*b* so that the axle 31*b* extends within an elongated slot 21*a* defined in the seat frame 5*b*. In some embodiments, the axle 31*b* may extend through a width of the slot 21*a* perpendicularly or transversely to the length of the slot 21*a*. In some embodiments, the elongated slot 21*a* can be polygonally shaped or oval shaped.

A connector 23 can have its first and second opposite ends fastened to the housing 3*b* to position the connector 23 in the slot 21*a* via holes 23*a* defined in the housing 3*b* to receive fasteners (e.g. bolts, screws, rivets, etc.) that pass through the connector 23 and into the holes 23*a* for attaching the connector 23 to the housing 3*b* for positioning the connector 23 within the slot 21*a*. The axle 31*b* can be located between the housing 3*b* and the connector 23 within the slot 21*a* of the seat frame 5*b* to help ensure the connector 23 attaches the seat frame 5*b* to the housing 3*b* at the portion 3*g* of the housing 3*b* to which the connector is fastened.

The front and rear terminal ends of the slots 21*a* can be configured to function in cooperation with the connector 23 and portion 3*g* of the housing 3*b* to define a forward and rearward path of travel for the seat. The rearward-most position of the seat may be defined by the forward end of the connector 23 fastened to the housing 3*b* contacting the portion of the seat frame 5*b* defining the forward end of slot 21*a*. The forward-most position of the seat 5 may be defined by the portion of the seat frame 5*b* defining the rear end of the slot 21*a* contacting the rearward terminal end of the connector 23 that is fastened to the housing 3*b*.

The second seat pivotal connections 15 between the backrest 7 and the seat 5 can be aligned with each other and can be located in corresponding locations on opposite sides of the housing 3*b*, seat frame 5*b*, and backrest 7. Each of the second seat pivotal connections 15 between the backrest 7 and the seat 5 can be located within a rearward aperture 21*b* located behind a respective one of the elongated slots 21*a* of the seat frame 5*b*. The rearward aperture 21*b* can be configured to receive a projection 7*c* that extends from a lower portion of the backrest 7 that is located below the opening 8 defined by the backrest 7 and is attached to the spaced apart lower ends of the vertically extending members 7*a*. Backrest projection connecting structure 32*a* can be positioned adjacent the rearward aperture 21*b* to facilitate the pivotal connection of a projection 7*c* of the backrest 7 to the seat frame 5.

The first end of the lower portion of the backrest 7 may be attached to a lower end of a first vertically extending member 7*a* adjacent a first side of the backrest and a second end of the lower portion of the backrest can be attached to a lower end of a second vertically extending member 7*a* adjacent a second side of the backrest 7. The projections 7*c* can be located between the first and second vertically extending members 7*a*. A distal end of each projection 7*c* can be positioned away from and forward of the backrest 7 for positioning within a respective aperture 21*b* or adjacent a respective aperture 21*b* of the seat frame for connection to the seat frame to form a seat pivotal connection 13. The distal end of each projection 7*c* can define a slit 7*d* in communication with a mouth that faces rearwardly for receiving an axle 32*b* that may extend horizontally within an aperture 21*b* of the seat frame 5*b* to define an axis about which the backrest may pivot.

A middle portion of the axle 32*b* can be received within the slit 7*d* after the axle is passed through the mouth for attachment of the projection 7*c* to the seat frame 5*b* to form the seat pivotal connection 15. The ends of the axle 32*b* can be received within structure 32*a* adjacent the aperture 21*b* to locate the axle 32*b* adjacent or within the aperture 21*b* and for attaching the projection 7*c* to the seat frame 5*b*. The housing 3*b* can have projection receiving openings 3*e* defined in a bottom side of the housing 3*b* so that the projections 7*c* can extend from the backrest 7, through these openings 3*e*, and to the apertures 21*b* so that the distal ends of the projections 7*c* can be hooked onto the axles 32*b* within the apertures 21*b* by passing the axles 32*b* through the mouths of the projections to locate the axles 32*b* within the slits 7*d* of the projections 7*c*. A fastener (e.g. a bolt, screw, or rivet, etc.) may be passed through the projections 7*c* to lock the axles 32*b* within the slits 7*d* after the projections have been moved into the apertures 21*b* within the housing 3*b*. The projections 7*c* can be shaped and structured so that as the backrest pivots rearwardly from an upright position to a reclined position about the axles 32*b*, the distal ends of the projections 7*c* push the seat frame 5*b* forwardly via their connection to the seat frame 5*b* via the axles 32*b* of the seat pivoting connections 15. Pivoting motion of the backrest 7 from its reclined position to an upright position can result in the projections moving rearwardly to drive motion of the seat rearwardly during the rotation of the backrest toward its upright position.

It should be appreciated that the slots 21*a* and connectors 23 can help define the path of travel of the seat 5 during pivotal motion of the backrest 7 between the backrest's upright and reclined positions while also defining how much rotation of the backrest 7 can occur via the apertures 21*b*, axles 32*b* and slits 7*d* of the projections 7*c* of the backrest 7 as the backrest 7 is moved from its upright position to its reclined position. The shape of the projections 7*c* and the size and shape of the projection receiving openings 3*e* of the housing 3*b* can also help define an extent of rotational motion of the backrest as it is moved from its upright position to its reclined position.

In some embodiments, the distal ends of projections 7*c* having slits 7*d* can have a different shaped structure for connection to axles 32*b* to form the seat pivotal connection 15. For instance, each of the distal ends 7*c* can be shaped to have a U-shaped distal end having holes in forwardly extending horizontally spaced apart arms of the U-shaped distal end structure so that the slit 7*d* is defined to have a mouth that faces forwardly (instead of slits having rearwardly facing mouths). Such a slit can be in communication with holes on opposite arms of the U-shaped distal end that are horizontally spaced apart from each other so that the distal end of the projection 7*c* can receive opposite end portions of an axle 32*b* and so that other structure can be positionable within the slit defined in the distal end that may be located adjacent the axle 32*b* and/or may be connected to the axle 32*b*. For example, a middle portion of the axle 32*b* can have a wheel, a pulley, or other structure positioned on the axle 32 and/or a portion of the seat frame 5*b* can extend to the axle 32*b* and have a hole through which axle 32*b* passes. The wheel, pulley, and/or seat frame structure can be positioned within the slit having the forwardly facing mouth defined in the U-shaped distal end of the projection 7*c*. The connection of the axle 32*b* to the projection 7*c* can also interconnect the projection 7*c* to the seat frame 5*b* and other structure that may be connected to the axle 32*b* that is received within the U-shaped distal end of the projection.

The third backrest pivotal connections 18 can be positioned so that these connections are aligned with each other and can be located on opposite sides of the backrest 7 and housing 3*b*. The third backrest pivotal connections 18 can be positioned so that they are located above the seat 5 or at locations that are near the top of the seat 5 but slightly below the seat 5 (e.g. below the top of the seat 5 by 1-5 centimeters (cm) or below the top of the seat 5 by 1-25 millimeters (mm)). Each of the third backrest pivotal connections 18 between the backrest 7 and the housing 3*b* can be formed by a vertically extending member 3*f* that extends upwardly from the housing 3*b* within recess 7*e* defined in a vertically extending member 7*a* of the backrest 7. The vertically extending members 3*f* of the housing 3*b* can be first and second arm portions of a yolk structure that is defined in a body of the housing 3*b* or that is attached to the housing 3*b*. Each of the vertically extending members 3*f* can have an upper distal end 3*h* that has a hole 3*i* for receiving an axle (e.g. a pin, screw, bolt, etc.). The hole 3*i* defined in the upper end of the vertically extending member 3*f* can align with a hole 7*g* defined in a recess 7*e* of a vertically extending member 7*a* of the backrest so that an axle 38 can extend from the vertically extending member 7*a* of the backrest 7 to the vertically extending member 3*f* of the housing for forming a pivotal connection between the vertically extending member 3*f* of the housing 3*b* and the vertically extending member 7*a* of the backrest 7.

The backrest 7 is configured via second seat pivotal connections 15 and third backrest pivotal connections 18 to rotate about the horizontal axles 38 and 32*b* when a user applies a force to recline the backrest 7. The rotation of the backrest 7 about these axles results in projections 7*c* rotating about axles 32*b* and forwardly moving the seat frame 5*b* (and thus the seat 5) forwardly as the backrest is tilted rearwardly to its reclined position due to the shape and size of the projections 7*c* and their connections to the seat frame 5*b* via axles 32*b*. The forward movement of the seat 5 has a defined path of forward travel of the seat 5 that is defined by the housing 3*b* and the first seat connections 13 that connect the seat 5 to the housing 3*b*. The defined path of travel may be a linear path of travel that is inclined so that forward motion of the seat also results in the seat's elevation changing so that it is moved to a higher location as it moves forwardly and is moved to a lower location as it moves rearwardly along the path of travel. The extent of the forward and upward travel of the seat 5 that is driven via reclining of the backrest 7 can be defined by the slots 21*a* in which the connectors 23 fastened to the housing 3*b* for connection of the seat 5 to the housing 3*b* via holes 23*a* are positioned. As the backrest 7 is reclined and the seat frame 5*b* is moved forwardly, the first and second biasing devices 12 and 14 may each be elongated, or stretched to a new second length L2 that is longer than their first length L1 via their connection between the forwardly moving seat frame and the non-moving housing 3*b*. Each stretched or extended biasing device 11*a* may provide a force as it is stretched to bias the seat 5 to move rearwardly for driving rotation of the backrest 7 about the second pivotal seat connections 15 and third pivotal backrest connections 18 to return the backrest to its upright position.

When a user removes the force he or she has exerted to recline the backrest by, for example, leaning forward or getting out of the seat 5, the biasing devices 11*a* may drive motion of the seat 5 rearwadly as the biasing devices 11*a* move from their second length L2 to their shorter first length L1 as the force exerted to overcome the biasing force provided by the biasing devices 11*a* has been removed by the user. The seat 5 may move rearwardly along a path of travel such that the seat is moved to a lower position as it is moved rearwardly. The rearward motion of the seat 5 driven by the motion of the biasing devices 11*a* can drive rotation of the backrest 7 about the axles 32*b* of the second seat pivotal connections 15. As the projections 7*c* of the backrest 7 rotate about the second seat pivotal connections 15 in response to the rearward motion of the seat 5 driven by the first and second biasing devices 12 and 14, the backrest 7 may also rotate about the axles 38 of the third backrest pivotal connections to rotate from the reclined position to the upright position.

It should be understood that the motion of the seat 5 and backrest 7 during reclining and during the motion of the seat and backrest from their reclined positions to their upright positions occurs relative to the housing 3*b* and base 3. The motion of the seat 5 occurs synchronously with the rotation of the backrest 7.

The path of travel of the seat 5 can be defined by a portion of the housing to which the connectors 23 of the first seat connections 13 are attached. The connectors 23 may be generally flat linearly extending bodies (e.g. oval shaped or rectangular shaped plate members, etc.) that are fastened to the housing 3*b* via holes 23*a* so that the connectors 23 are inclined or declined at an angle relative to horizontal. The holes 23*a* can be located in ramped portions 3*g* of the housing 3*b*. For facilitating a seat height increase that may occur when the seat is moved forwardly and a seat height decrease that may occur when the seat is moved rearwardly, the ramped portions can have a front end that is higher than the rear end (e.g. the forward-most hole 23*a* can be in a portion of the ramp that is elevated relative to a rearward hole 23*a* of a ramp portion). For facilitating a seat height decrease that may occur when the seat is moved forwardly and a seat height increase that may occur when the seat is moved rearwardly, the ramped portions 3*g* can have a front end that is lower than the rear end (e.g. the rear-most hole 23*a* can be in a portion of the ramp that is elevated relative to a front hole 23*a* of a ramp portion). In some embodiments, the degree of inclination or declination may be 1°-15°, 5°-15°, 1°-30° or between 5°-45°. In other embodiments, the connectors 23 may be curved or have an arc-like shape and be attached to a correspondingly curved shaped portion of the housing to define a curved path of travel for the seat 5 for vertical and horizontal motions of the seat (e.g. forward motion that occurs at the same time the seat moves upward or downward motion and rearward motion that occurs at the same time the seat moves upward or downward). The portion 3*g* of the housing 3*b* to which a connectors 23 is attached for each seat connection 13 can be ramped portions that are inclined or declined so that the seat 5 increases in height or becomes lower in height as the seat 5 is moved forwardly during recline of the seat 5.

Embodiments of the chair can also have stop elements 41, such as an upright stop 41*a* and a recline stop 41*b*. The stop elements 41 can be configured to help define terminal ends for the path of travel of the seat 5 and backrest 7 between their upright and reclined positions. The stop elements 41 can be positioned on or adjacent the housing 3*b* to engage at least one portion of the backrest or a stop engagement element attached to the backrest that may move as the backrest is tilted between its upright and reclined positions to define the terminal ends of the path of travel for the backrest 7 and the seat 5 between their upright and reclined positions.

For example, the upright stop 41*a* can be connected to a portion of the housing 3*b* and be configured to engage a portion of a projection 7*c* of the backrest when the backrest 7 is in its upright position to prevent further forward motion of the backrest 7 beyond the upright position defined by the upright stop 41*a*. The prevention of motion of the backrest 7 can also function to prevent motion of the seat that may occur synchronously with motion of the backrest as the backrest tilts forwardly. The recline stop 41*b* can be attached to the housing 3*b* to engage a portion of a projection 7*c* to prevent further rearward titling of the backrest 7. The prevention of further rearward tilting of the backrest can also function to prevent further motion of the seat 5 in the direction the seat 5 may move synchronously with rearward tilting of the backrest 7. The engagement of the stop elements 41 with a portion of the projection 7*c* may be engagement to different portions or to the same portion of the projection 7*c* or may be an engagement to a stop engagement element attached to the projection (e.g. formed in the projection 7*c* or attached to the projection 7*c* via a fastener or other type of attachment mechanism).

Each of the stop elements can include an engagement body that is configured to provide a resilient or deformable contact to the stop engagement element so that the terminal end of the motion of the seat and backrest occurs in a way so that the user experiences a "soft" end to the reclining or uprighting of the backrest 7 and synchronous motion of the seat that occurs while the backrest 7 tilts between its upright and reclined positions. Such a resilient or deformable contact can be provided by material properties of these elements or by these elements including a resilient or deformable contacting element(s) (e.g. an element made of a rubber or elastomeric material, etc.).

It should be understood that each projection 7*c* that passes into the housing for coupling the backrest to the seat can be configured to engage respective upright and recline stops 41*a* and 41*b* as those projections 7*c* move within the housing 3*b* during tilting of the backrest 7. For instance, embodiments of the chair that utilize a backrest having two projections 7*c*, may have two sets of upright and recline stops 41*a* and 41*b* with each set of stop elements being configured to engage a respective one of the projections 7*c*. In other embodiments, only one projection 7*c* may be configured to have a portion that is configured to function as a stop engagement element or have a stop engagement element attached thereto for engaging the stop elements 41. In yet other embodiments, a backrest 7 may have more than two projections 7*c*, but only have one or two of those projections 7*c* configured to have a portion that is configured to function as a stop engagement element or have a stop engagement element attached thereto for engaging stop elements 41 of a respective set of upright and recline stops 41*a* and 41*b*.

In some embodiments, the recline stops can have different configurations. For example, the forward-most stop 41*a* can be removed and not used and another type of stop feature can be utilized to replace that stop. For instance, the shape and configuration of recesses 7*e* so that portions of the vertically extending members 7*a* defining the recesses function as recline stops or so that stop elements within the recesses 7*e* function as stops by engaging vertically extending members 3*f*.

It should be appreciated that embodiments of the chair may utilize many different feature arrangements to meet different sets of design criteria. For instance, the seat 5 may be a unitary structure composed of polymeric material or may be a structure that has many interconnected components, such as a foam member that is positioned between a fabric or leather covering and a rigid plate component or other intermediate structural component positioned above the feet or castors of the chair and below the seat 5 of the chair. For instance, the seat may include a covering that may be a fabric or mesh material that is sewn, adhered or otherwise attached to a relatively rigid polymeric plate or metal plate to enclose a foam member, such as a foam cushion. As yet another example, it should be appreciated that the shape and configuration of the base of the chair may be any of a number of different configurations needed to meet a particular design objective that permit the base to support the set, chair back, and a user sitting on the seat and leaning on the chair back. As yet another example, the height adjustment mechanism used to actuate seat height adjustment may include only one gas spring or may include another type of lifting mechanism coupled to an actuator that is manipulatable to actuate height adjustment (e.g. a button, lever, or other actuator that is coupled to a component of the height adjustment mechanism via a connector such as a wire or cable or lever such that manipulation of the actuator causes the height adjustment mechanism to move to permit adjustment of the height of the seat). As yet another example, each of the armrests 9 can be configured to be affixed in a stationary manner or may be configured to be moveably attached to permit rotational and/or height adjustment of the position of the armrest 9. The armrests 9 can be attached to the backrest frame, the backrest, the seat frame of the seat 5, the seat 5, or the base, and/or a housing or other element positioned under the seat frame 5 that is supported by legs or a pedestal base. As yet another example, the composition of the structures of the housing 3*b*, backrest 7, armrest 9, and seat frame 5*b* can be any of a number of different suitable materials. For example, all of these components may be composed of a polymeric material, or some may be composed of a polymeric material while others are composed of metal or other type of material. For instance, in some embodiments, the housing 3*b* can be metal, the armrests 9 and backrest 7 may be composed of a polymeric material or an elastomeric material, the seat frame 5*b* may be composed of metal or a polymeric material, the cushion 5*a* can be composed of a foam material, and the covering that may cover the cushion 5*a* may be a mesh material, a fabric, or leather. In other embodiments, the seat 5 can be structures so that a covering is extended over the seat frame 5*b* so that a cushion is not needed or a smaller cushion can be utilized for the seat. Such a covering can be composed of fabric, an elastomeric material, a polymeric material, or mesh material in some embodiments. As yet another example, it is contemplated that a particular feature described, either individually or as part of an embodiment, can be combined with other individually described features, or parts of other embodiments. The elements and acts of the various embodiments described herein can therefore be combined to provide further embodiments. Therefore it should be understood that while certain exemplary embodiments of a chair and methods of making and using a chair have been discussed and illustrated herein, it is to be distinctly understood that the invention is not limited thereto but may be otherwise variously embodied and practiced within the scope of the following claims.

What is claimed is:

1. A chair comprising:

a seat a backrest a base, the seat supported by the base, at least one portion of the backrest connected to at least one of a seat frame of the seat and the base; and a tilt mechanism attached between the base, the seat, and the backrest, the tilt mechanism comprising:

seat connections between the seat frame of the seat and a housing of the base that are configured to define a path of travel of the seat when the seat moves during recline of the backrest from an upright position to a reclined position;

seat pivotal connections between projections of the backrest and the seat frame of the seat that are configured so that the projections rotate during rotation of the backrest from the upright position to the reclined position to drive the seat frame forward along the path of travel during the recline of the backrest from the upright position to the reclined position;

backrest pivotal connections between vertically extending members of the backrest and vertically extending members of the housing, the backrest rotating about the backrest pivotal connections and the seat pivotal connections during motion of the backrest between the upright position and the reclined position;

a first biasing device attached between the seat frame and the housing, the first biasing device configured to stretch from a first length to a second length that is longer than the first length when the seat is moved forwardly as the backrest is moved from the upright position to the reclined position, the first biasing device configured to bias the seat to a rearward position to bias the backrest to the upright position;

wherein the seat moves forwardly synchronously with rotation of the backrest during recline of the backrest from the upright position to the reclined position;

wherein each of the seat pivotal connections between projections of the backrest and the seat frame of the seat comprise:

a first axle that extends through a slit defined in the projection of the backrest of the seat pivotal connection adjacent an aperture defined in the seat frame that is rearward of a slot of a respective one of the seat connections, the first axle pivotally connecting the projection of the backrest to the seat frame.

2. The chair of claim 1, wherein each of the seat connections comprises:

a connector positioned within an elongated slot defined in the seat frame connected to a portion of the housing to attach the housing to the seat frame.

3. The chair of claim 2, wherein the portion of the housing to which the connector is attached is a ramped portion so that the connector is inclined or declined within the slot to define an inclined or declined path of travel of the seat so that the seat moves upwardly or downwardly as the seat moves forwardly.

4. A chair comprising:

a seat;

a backrest;

a base, the seat supported by the base, at least one portion of the backrest connected to at least one of a seat frame of the seat and the base; and a tilt mechanism attached between the base, the seat, and the backrest, the tilt mechanism comprising:

seat connections between the seat frame of the seat and a housing of the base that are configured to define a path of travel of the seat when the seat moves during recline of the backrest from an upright position to a reclined position;

seat pivotal connections between projections of the backrest and the seat frame of the seat that are configured so that the projections rotate during rotation of the backrest from the upright position to the reclined position to drive the seat frame forward along the path of travel during the recline of the backrest from the upright position to the reclined position;

backrest pivotal connections between vertically extending members of the backrest and vertically extending members of the housing, the backrest rotating about the backrest pivotal connections and the seat pivotal connections during motion of the backrest between the upright position and the reclined position;

wherein the seat moves forwardly synchronously with rotation of the backrest during recline of the backrest from the upright position to the reclined position;

wherein each of the seat pivotal connections between projections of the backrest and the seat frame of the seat comprise:

a first axle that extends through a slit defined in the projection of the backrest of the seat pivotal connection adjacent an aperture defined in the seat frame that is rearward of a slot of a respective one of the seat connections, the first axle pivotally connecting the projection of the backrest to the seat frame; and wherein each of the seat connections comprises:

a connector positioned within an elongated slot defined in the seat frame connected to a portion of the housing to attach the housing to the seat frame, wherein the portion of the housing to which the connector is attached is a ramped portion so that the connector is inclined or declined within the slot to define an inclined or declined path of travel of the seat so that the seat moves upwardly or downwardly as the seat moves forwardly.

5. The chair of claim 1, wherein the base comprises a height adjustment device connected to the housing and an actuator connected to the height adjustment device.

6. The chair of claim 5, wherein the actuator is connected to the height adjustment device within the housing below the seat.

7. The chair of claim 5, wherein each of the backrest pivotal connections between vertically extending members of the backrest and vertically extending members of the housing comprises:

a second axle extending from an upper end of a vertically extending member of the housing to a vertically extending member of the backrest such that the backrest is rotatable about the second axle.

8. The chair of claim 7, wherein the first axle pivotally connecting the projection of the backrest to the seat frame so that rotation of the projection that occurs when the backrest is moved from the upright position to the reclined position drives the seat frame forwardly.

9. A chair comprising:

a seat a backrest a base, the seat supported by the base, at least one portion of the backrest connected to at least one of a seat frame of the seat and the base; and a tilt mechanism attached between the base, the seat, and the backrest, the tilt mechanism comprising:

seat connections between the seat frame of the seat and a housing of the base that are configured to define a path of travel of the seat when the seat moves during recline of the backrest from an upright position to a reclined position;

seat pivotal connections between projections of the backrest and the seat frame of the seat that are configured so that the projections rotate during rotation of the backrest from the upright position to the reclined position to drive the seat frame forward along the path of travel during the recline of the backrest from the upright position to the reclined position;

backrest pivotal connections between vertically extending members of the backrest and vertically extending members of the housing, the backrest rotating about the backrest pivotal connections and the seat pivotal connections during motion of the backrest between the upright position and the reclined position;

wherein the seat moves forwardly synchronously with rotation of the backrest during recline of the backrest from the upright position to the reclined position;

wherein each of the backrest pivotal connections between vertically extending members of the backrest and vertically extending members of the housing comprises:

a first axle extending from an upper end of a vertically extending member of the housing to a vertically extending member of the backrest such that the backrest is rotatable about the first axle;

wherein each of the seat pivotal connections between projections of the backrest and the seat frame of the seat comprises:

a second axle that extends through a slit defined in the projection of the backrest of the seat pivotal connection adjacent an aperture defined in the seat frame, the second axle pivotally connecting the projection of the backrest to the seat frame so that rotation of the projection that occurs when the backrest is moved from the upright position to the reclined position drives the seat frame forwardly;

wherein each of the seat connections comprises:

a connector positioned within an elongated slot defined in the seat frame to attach the seat frame to the housing;

wherein the portion of the housing to which the connector is attached is a ramped portion so that the connector is inclined or declined within the slot to define an inclined or declined path of travel of the seat so that the seat moves upwardly or downwardly as the seat moves forwardly.

10. A chair comprising:

a seat a backrest a base, the seat supported by the base, at least one portion of the backrest connected to at least one of a seat frame of the seat and the base; and a tilt mechanism attached between the base, the seat, and the backrest, the tilt mechanism comprising:

seat connections between the seat frame of the seat and a housing of the base that are configured to define a path of travel of the seat when the seat moves during recline of the backrest from an upright position to a reclined position;

seat pivotal connections between projections of the backrest and the seat frame of the seat that are configured so that the projections rotate during rotation of the backrest from the upright position to the reclined position to drive the seat frame forward along the path of travel during the recline of the backrest from the upright position to the reclined position;

backrest pivotal connections between vertically extending members of the backrest and vertically extending members of the housing, the backrest rotating about the backrest pivotal connections and the seat pivotal connections during motion of the backrest between the upright position and the reclined position;

wherein the seat moves forwardly synchronously with rotation of the backrest during recline of the backrest from the upright position to the reclined position;

wherein each of the seat pivotal connections between projections of the backrest and the seat frame of the seat comprise:

a first axle that extends through a slit defined in the projection of the backrest of the seat pivotal connection adjacent an aperture defined in the seat frame that is rearward of a slot of a respective one of the seat connections, the first axle pivotally connecting the projection of the backrest to the seat frame; and wherein the backrest comprises:

an upper portion, a lower portion having the projections, the projections extending from the lower portion of the backrest into the housing, the upper portion, lower portion, and the vertically extending members of the backrest defining at least one opening;

wherein the vertically extending members of the backrest comprise a first vertically extending member and a second vertically extending member, the first vertically extending member adjacent a first side of the backrest and the second vertically extending member adjacent a second side of the backrest.

11. The chair of claim 10, wherein each of the seat connections comprises:

a connector positioned within an elongated slot defined in the seat frame to attach the seat frame to the housing.

12. The chair of claim 11, wherein a portion of the housing to which the connector is attached is a ramped portion so that the connector is inclined or declined within the slot to define an inclined or declined path of travel of the seat so that the seat moves upwardly or downwardly as the seat moves forwardly.

13. The chair of claim 11, wherein the connector is forward of the seat pivotal connections and the seat pivotal connections are forward of the backrest pivotal connections.

14. The chair of claim 11, wherein the projections of the backrest extend from a lower portion of the backrest through holes in the housing to the seat pivotal connections.

15. The chair of claim 10, comprising:

a first biasing device attached between the seat frame and the housing, the first biasing device configured to stretch from a first length to a second length that is longer than the first length when the seat is moved forwardly as the backrest is moved from the upright position to the reclined position, the first biasing device configured to bias the seat to a rearward position to bias the backrest to the upright position.

16. The chair of claim 15, wherein each of the seat connections comprises:

a connector positioned within the slot defined in the seat frame to attach the seat frame to the housing.

17. The chair of claim 16, wherein the portion of the housing to which the connector is attached is a ramped portion so that the connector is inclined or declined within the slot to define an inclined or declined path of travel of the seat so that the seat moves upwardly or downwardly as the seat moves forwardly.

18. A chair comprising:

a seat;

a backrest;

a base, the seat supported by the base, at least one portion of the backrest connected to at least one of a seat frame of the seat and the base; and a tilt mechanism attached between the base, the seat, and the backrest, the tilt mechanism comprising:

seat connections between the seat frame of the seat and a housing of the base that are configured to define a path of travel of the seat when the seat moves during recline of the backrest from an upright position to a reclined position;

seat pivotal connections between projections of the backrest and the seat frame of the seat that are configured so that the projections rotate during rotation of the backrest from the upright position to the reclined position to drive the seat frame forward along the path of travel during the recline of the backrest from the upright position to the reclined position;

backrest pivotal connections between vertically extending members of the backrest and vertically extending members of the housing, the backrest rotating about the backrest pivotal connections and the seat pivotal connections during motion of the backrest between the upright position and the reclined position;

wherein the seat moves forwardly synchronously with rotation of the backrest during recline of the backrest from the upright position to the reclined position;

first and second biasing devices attached between the seat frame and the housing, the first biasing device being spaced apart from the second biasing device within the housing, each of the first and second biasing device configured to stretch from a first length to a second length that is longer than the first length when the seat is moved forwardly as the backrest is moved from the upright position to the reclined position, the first and second biasing devices configured to bias the seat to a rearward position to bias the backrest to the upright position;

wherein the seat connections between a seat frame of the seat and the housing of the base that are configured to define a path of travel of the seat when the seat moves during recline of the backrest from an upright position to a reclined position comprise first and second seat connections that are aligned with each other and are spaced apart from each other, the seat connections being forward of the seat pivotal connections;

the seat pivotal connections between the projections of the backrest and the seat frame of the seat that are configured so that the projections rotate during rotation of the backrest from the upright position to the reclined position to drive the seat frame forward along the path of travel during recline of the backrest from the upright position to the reclined position comprise first and second seat pivotal connections that are spaced apart from each other and aligned with each other, the seat pivotal connections being forward of the backrest pivotal connections; and the backrest pivotal connections between the vertically extending members of the backrest and the vertically extending members of the housing comprising first and second backrest pivotal connections that are spaced apart from each other and are aligned with each other, the backrest pivotal connections being rearward of the seat connections and the seat pivotal connections;

wherein the backrest comprises:

an upper portion, a lower portion having the projections, the projections extending from the lower portion of the backrest into the housing, the upper portion, lower portion, and the vertically extending members of the backrest defining at least one opening;

wherein the vertically extending members of the backrest comprise a first vertically extending member and a second vertically extending member, the first vertically extending member adjacent a first side of the backrest and the second vertically extending member adjacent a second side of the backrest.

19. The chair of claim 18, wherein each of the backrest pivotal connections between vertically extending members of the backrest and vertically extending members of the housing comprises:

a first axle extending from an upper end of the vertically extending member of the housing to the vertically extending member of the backrest of the backrest pivotal connection such that the backrest is rotatable about the first axle;

wherein each of the seat pivotal connections between the projections of the backrest and the seat frame of the seat comprises:

a second axle that extends through a slit defined in the projection of the backrest of the seat pivotal connection adjacent an aperture defined in the seat frame, the second axle pivotally connecting the projection of the backrest to the seat frame so that rotation of the projection that occurs when the backrest is moved from the upright position to the reclined position drives the seat frame forwardly; and wherein each of the seat connections comprises:

a connector positioned within an elongated slot defined in the seat frame to attach the seat frame to the housing, a portion of the housing to which the connector is attached being a ramped portion so that the connector is inclined or declined within the slot to define an inclined or declined path of travel of the seat so that the seat moves upwardly or downwardly as the seat moves forwardly.

* * * * *